US005575209A

United States Patent [19]

Bayer et al.

[11] Patent Number: 5,575,209

[45] Date of Patent: Nov. 19, 1996

[54] PREGRIPPER FOR A PRINTING MACHINE

[75] Inventors: Harald Bayer, Rodgau; Klemens Kemmerer, Seligenstadt, both of Germany

[73] Assignee: MAN Roland Druckmaschinen AG, Germany

[21] Appl. No.: 548,102

[22] Filed: Oct. 25, 1995

[30] Foreign Application Priority Data

Oct. 29, 1994 [DE] Germany ..... 44 38 757.1

[51] Int. Cl.[6] ..... B41F 1/30

[52] U.S. Cl. ..... 101/408; 101/232

[58] Field of Search ..... 101/409, 408, 101/225, 410, 411, 412, 232

[56] References Cited

U.S. PATENT DOCUMENTS 5,303,650 4/1994 Wieland ..... 101/409

FOREIGN PATENT DOCUMENTS 614043 5/1935 Germany .
2156577 7/1974 Germany .
3529-596-A 2/1987 Germany ..... 101/409

*Primary Examiner*—Edgar S. Burr
*Assistant Examiner*—Dave A. Ghatt
*Attorney, Agent, or Firm*—Leydig, Voit & Mayer, Ltd.

[57] ABSTRACT

A pregripper for transferring sheets from a sheet feeder to a feed drum or impression cylinder of a printing machine is provided. The pregripper is disposed below the sheet feeder and includes a hollow tube which has a substantially pear-shaped cross-section. The pear-shaped cross-section is defined by a first apex having a greater curvature and a second apex having a lesser curvature relative to the first apex. The hollow tube also has an exterior wall having a thickness that increases as the wall extends from the first apex to the second apex. A web which supports a conventional gripper bridge is attached to the hollow tube adjacent the first apex. The hollow tube is rotatably supported on each end by a journal such that the axis of rotation of the hollow tube is substantially concentric with the center of curvature of the second apex. In an alternative embodiment, the hollow tube has a plurality of openings extending therethrough substantially in the transverse direction which are adapted to prevent the build-up of a dynamic air pressure between the sheets and the pregripper.

11 Claims, 3 Drawing Sheets

PREGRIPPER FOR A PRINTING MACHINE

FIELD OF THE INVENTION

The present invention relates generally to printing machines, and more particularly to a pregripper in a sheet-fed rotary printing machine.

BACKGROUND OF THE INVENTION

Typically, pregrippers are used for the transfer of a sheet from a sheet feeder to a feed drum or an impression cylinder of a rotary printing machine. In order to ensure that the sheets are printed properly, the sheet feeder feeds the sheets to the pregripper with a predetermined alignment and the pregripper accurately transfers the aligned sheets to the feed drum or the impression cylinder in register.

A pregripper of this type is disclosed in DE-B 2,156,577, in which the pre-gripper essentially comprises a plurality of gripper bridges that are attached to holders which are releasably attached to a cylindrical tube. A problem with this design is that the pregripper has difficulty maintaining accurate in-register transfer of sheets when the printing machine is running at a high speed because the cylindrical tube tends to bend and twist. The bending and twisting of the cylindrical tube disrupts the transfer of the sheets causing them to be transferred out of register which results in lower quality printing. This problem is particularly acute when the printing operation requires both high printing machine speeds and relatively high register accuracy.

Another problem with this pregripper design is its complexity. The complex design makes it more difficult and time consuming for the pregripper to be assembled and disassembled. For example, in order to remove the cylindrical tube a driving lever must first be removed from the tube. The extra time required for assembly and disassembly of the pregripper increases both the cost and the production downtime associated with maintaining the pregripper.

OBJECTS AND SUMMARY OF THE INVENTION

It is an object of the invention to provide a pregripper which has a high bending and torsional rigidity thus assuring sheets are transferred in register when the printing machine is running at a high speed.

It is related object of the present invention to provide a pregripper which can be disassembled and assembled quickly and easily.

In accordance with these and other objects of the invention, a pregripper is provided for use in a sheet-fed rotary printing machine. The pregripper is disposed in the printing machine below a sheet feeder and is adapted to receive sheets from the sheet feeder, accelerate the sheets to the rotational speed of the printing machine, and transfer the sheets to a feed drum or impression cylinder with the proper register. The pregripper includes a hollow tube which has a substantially pear-shaped cross-section that is characterized by a first apex with a greater curvature and a second apex with a lesser curvature relative to the first apex. The thickness of the exterior wall of the hollow tube increases as the wall extends from the first apex towards the second apex. The configuration of the wall and the pear-shaped cross-section give the hollow tube bending and torsional rigidity even when the printing machine is operating at a high speed.

A web is integral with the hollow tube adjacent the first apex. A conventional gripper bridge is attached to the web for receiving the sheets from the sheet feeder. In order to move the sheet held by the gripper bridge to the feed drum or the impression cylinder, the hollow tube is adapted to oscillate. More particularly, the hollow tube is rotatably supported on each end by a journal which is disposed in a bearing in one of the side frames of the printing machine. The journals support the hollow tube in a particular orientation such that the axis of rotation of the cylinder is substantially concentric with the center of curvature of the second apex of the hollow tube.

In an alternative embodiment, a plurality of openings are provided in the hollow tube in substantially the transverse direction. The openings are adapted to allow air to flow through the hollow tube, thus, preventing any build-up of a positive or negative air pressure between the sheet and the pregripper. Alternatively, openings could be provided in the web or in the gripper impact strip portion of the gripper bridge in order to achieve the same objective.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
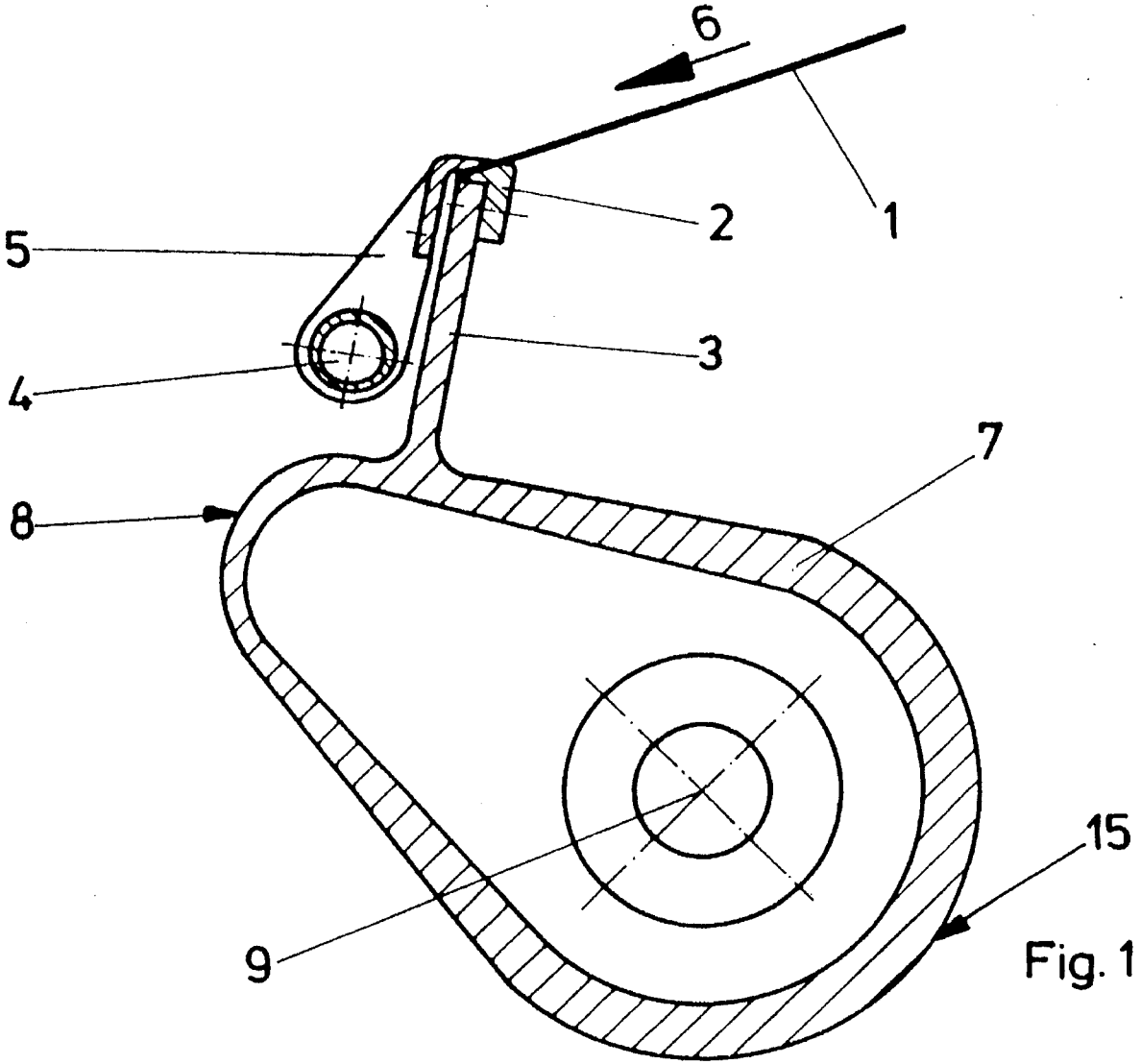
FIG. 1 is a sectional view taken along line A—A in FIG. 2 showing a sheet feeder and the pregripper of the present invention.

FIG. 1 illustrates, in schematic form, a pregripper which is disposed in a sheet-fed rotary printing machine below a sheet feeder 1. The pregripper receives sheets of paper, card stock, or metal foil fed in a conveying direction 6 via the sheet feeder 1, accelerates the sheets to the rotational speed of the printing machine, and transfers the sheets to a feed drum or an impression cylinder (not shown). As can be seen in FIG. 1, the pregripper accomplishes this with a design which includes a hollow tube 7, a web 3, and a gripper bridge.

In order to ensure that the pregripper transfers the sheets accurately and with the proper register when the printing machine is operating at a high speed, the hollow tube 7 has a cross-section and a wall configuration that give the hollow tube substantial bending and torsional rigidity. Pursuant to the present invention and as shown in FIG. 1, the hollow tube 7 has a substantially pear-shaped cross-section defined by a first apex 8 which has a greater curvature and a second apex 15 which has a lesser curvature in relation to the curvature of the first apex 8. As also shown in FIG. 1, the thickness of the exterior wall of the hollow pear-shaped tube 7 increases as the wall extends from the first apex 8 towards the second apex 15. In order to reduce the weight of the hollow tube 7, it is preferably constructed of aluminum or an aluminum alloy. Alternatively, a further reduction in mass could be achieved by constructing the hollow tube 7 with a carbon fiber reinforced material.

The pregripper has a conventional gripper bridge which enables the pregripper to receive the sheets fed by the sheet feeder 1. The gripper bridge is arranged on a web 3 which is preferably integral with the hollow tube 7 adjacent to the first apex 8. As shown in FIG. 1, the gripper bridge comprises a gripper shaft 4 which has a plurality of grippers 5 (only one is shown) attached thereto and a gripper impact strip 2.

Figure 2:
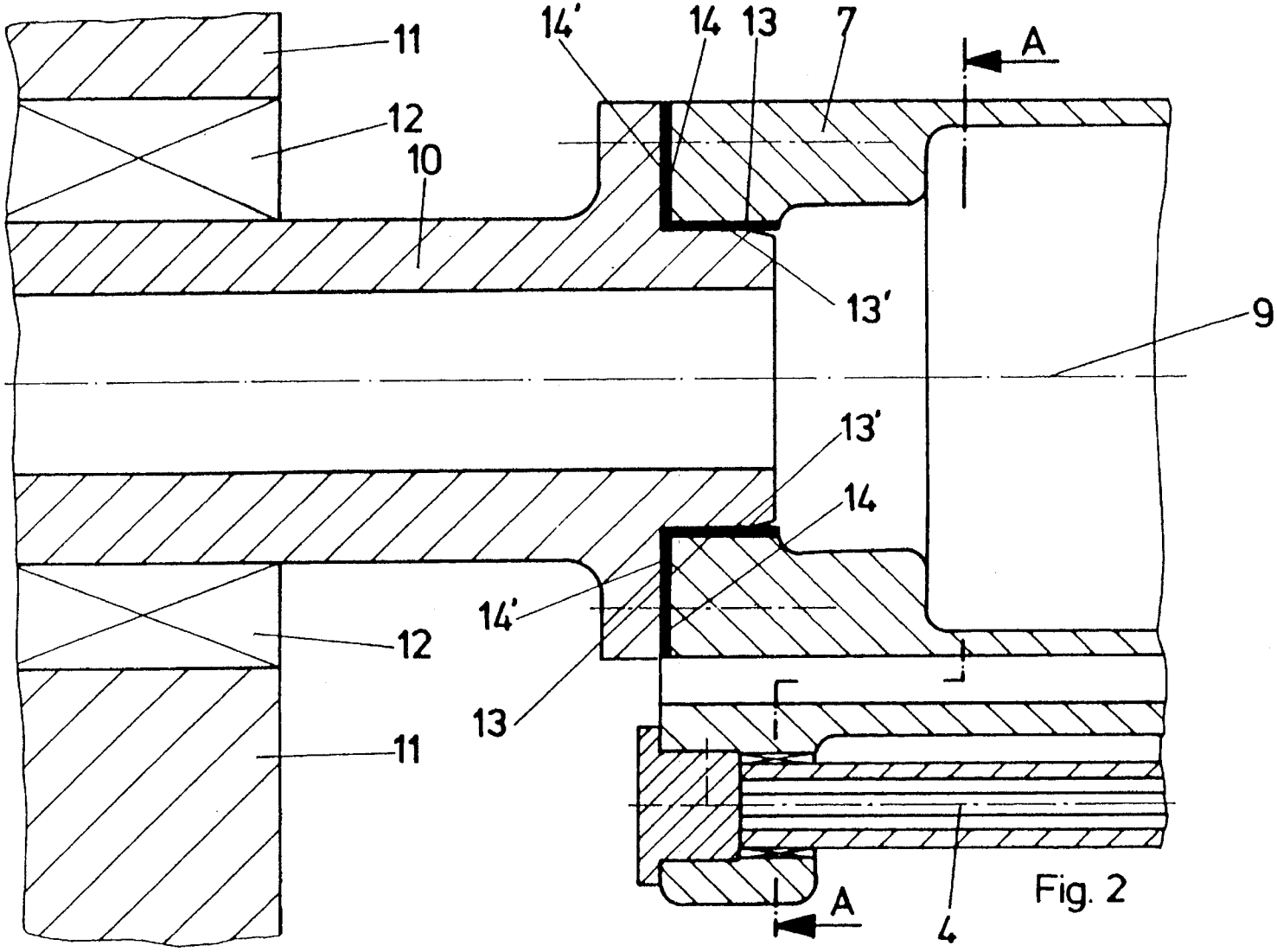
FIG. 2 is a partial front view of the pregripper of the present invention.

In order to move the sheet held in the gripper bridge from the feeder 1 to the feed drum or the impression cylinder, the pregripper is adapted to oscillate. Each end of the hollow tube 7 is rotatably supported by a journal 10 such that the axis of rotation 9 of the pregripper is adjacent the second apex 15 of the hollow tube. More particularly, the axis of rotation 9 of is substantially concentric with the center of curvature of the second apex 15. Only one end of the hollow tube 7 and one of the journals 10 are shown in FIG. 2, however, the opposite end of the tube and the opposite journal are similarly arranged. Each journal 10 is mounted in a bearing 12 in the opposed side frames 11 (only one of which is shown in FIG. 2) of the printing machine such that each journal 10 extends into the gap between the opposing side frames 11. In the preferred embodiment, the axis of rotation 9 of the pregripper is substantially coaxial with the axis representing the center of inertia of the pregripper.

In order to facilitate the proper positioning of the hollow tube 7 on the journal 10 in the axial and radial directions, each end of the hollow tube 7 has a planar end face portion 14 and an annular collar portion 13 and each journal 10 has a complimentary planar shoulder portion 14' and a complimentary neck portion 13'. When the hollow tube 7 is properly positioned axially on the journal 10 the planar end face 14 of the hollow tube 7 and the planar shoulder 14' of the journal 10 abut against each other. Likewise, the annular collar portion 13 of the hollow tube 7 and the neck portion 13' of the journal 10 coaxially engage each other when the hollow tube 7 is in the proper position radially on the journal 10. Once the hollow tube 7 is properly positioned on the journal 10, it is releasably attached to the journal 10 with a plurality of connecting screws, which are depicted in FIG. 2 as dot-dash lines through the shoulder portion 14' and into the end face 14 of the tube 7.

Figure 3:
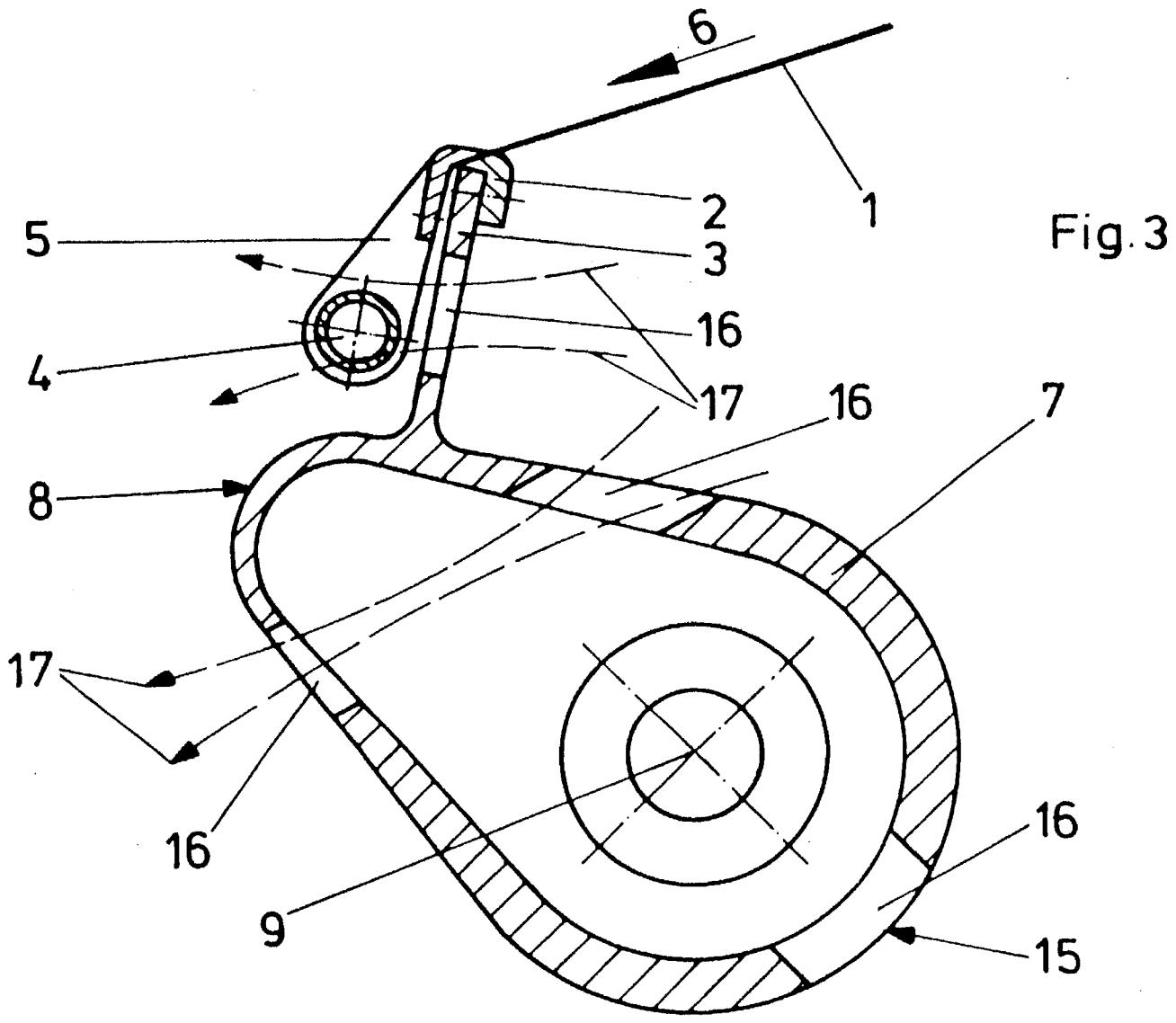
FIG. 3 is a view similar to FIG. 1 showing an alternative embodiment of the present invention.

Illustrated in FIG. 3 is an alternative embodiment of the pregripper which includes a plurality of openings 16 in the hollow tube 7 in substantially the transverse direction and an opening 16 in the web 3. The openings 16 are adapted to help prevent the build-up of a positive or negative dynamic air pressure between the sheet and the pregripper when the printing machine is operating at a high speed. If dynamic air pressure was allowed to build between the sheet and the pregripper, it would adversely effect the ability of the pregripper to transfer the sheets in register. As shown in FIG. 3, the openings 16 allow air 17 to flow through the hollow tube 7 and the web 3, thus, preventing any air pressure build-up between the sheet and the pregripper. Alternatively, the air pressure build-up can be avoided by providing openings in the gripper impact strip 2.

While this invention has been described with an emphasis upon certain preferred embodiments, it will be obvious to those of ordinary skill in the art that variations of the preferred embodiments may be used and that it is intended that the invention may be practiced otherwise than as specifically described herein. Accordingly, it is also intended that this invention includes all modifications encompassed within the spirit and scope of the invention as defined by the following claims.

We claim as our invention:

1. A pregripper for transferring sheets between a sheet feeder and a feed drum or an impression cylinder of a rotary printing machine having opposing side frames, said pregripper comprising, in combination:

a hollow tube having two ends and a substantially pear-shaped cross section characterized by a first apex with a greater curvature and a second apex having a curvature which is less than said greater curvature;

a journal releasably attached to each of said ends of said tube and rotatably mounted on said opposing side frames such that the axis of rotation of said hollow tube is adjacent said second apex; and a gripper bridge arranged adjacent said first apex and including a gripper shaft, a gripper impact strip, and a plurality of grippers.

2. A pregripper as defined in claim 1 wherein said hollow tube has a web attached thereto adjacent said first apex and said gripper bridge is attached to said web.

3. A pregripper as defined in claim 1 wherein said axis of rotation of said hollow tube is substantially concentric with the center of curvature of said second apex.

4. A pregripper as defined in claim 1 wherein said hollow tube includes an exterior wall having a thickness which increases as said wall extends from said first apex to said second apex.

5. A pregripper as defined in claim 1 wherein said hollow tube has openings extending therethrough substantially in the transverse direction which are adapted to prevent the build-up of a positive or negative dynamic air pressure between said pregripper and said sheets.

6. A pregripper as defined in claim 1 wherein each end of said hollow tube has an end face portion and each of said journals has a complimentary shoulder portion which abuts against said end face portion when said hollow tube is releasably attached to said journals and each end of said hollow tube has a neck portion and each of said journals has a complimentary annular collar portion which coaxially engages said neck portion when said hollow tube is releasably attached to said journals.

7. A pregripper as defined in claim 1 wherein each of said journals is mounted in a bearing in one of said opposing side frames.

8. A pregripper as defined in claim 1 wherein said hollow tube is made of aluminum.

9. A pregripper as defined in claim 1 wherein said hollow tube is made of an aluminum alloy.

10. A pregripper as defined in claim 1 wherein said hollow tube is made of a carbon fiber reinforced material.

11. A pregripper as defined in claim 1 wherein said pregripper has a moment of inertia which lies on said axis of rotation.

* * * * *